US006367221B1

(12) United States Patent
Elliott

(10) Patent No.: US 6,367,221 B1
(45) Date of Patent: Apr. 9, 2002

(54) SELF-ALIGNING SHINGLES

(75) Inventor: Bert Whitmore Elliott, Westerville, OH (US)

(73) Assignee: Owens Corning Fiberglas Technology, Inc., Summit, IL (US)

( * ) Notice: Subject to any disclaimer, the term of this patent is extended or adjusted under 35 U.S.C. 154(b) by 0 days.

(21) Appl. No.: 09/652,202

(22) Filed: Aug. 31, 2000

(51) Int. Cl.[7] ..... E04D 1/28

(52) U.S. Cl. ..... 52/519; 52/518; 52/543; 52/535; 52/536

(58) Field of Search ..... 52/539, 519, 518, 52/592.1, 592.6, 535, 536, 540, 542, 553

(56) References Cited

U.S. PATENT DOCUMENTS

| | | | | | |
|---|---|---|---|---|---|
| 1,740,217 | A | | 12/1929 | Batcheller | |
| 1,979,862 | A | | 11/1934 | Cannon | |
| 2,080,671 | A | | 5/1937 | Overbury | |
| 2,210,941 | A | | 8/1940 | Leemhuis | |
| 3,309,831 | A | | 3/1967 | Misch et al. | |
| 3,626,651 | A | * | 12/1971 | Kough | 52/536 |
| 3,921,358 | A | | 11/1975 | Bettoli | |
| 4,301,633 | A | | 11/1981 | Neumann | |
| 4,372,090 | A | * | 2/1983 | Shichijo | 52/536 |
| 4,499,701 | A | | 2/1985 | Bockwinkel et al. | |
| 4,586,309 | A | * | 5/1986 | Ferguson | 52/540 |
| 4,603,529 | A | | 8/1986 | Cronenwett et al. | |
| 4,803,818 | A | * | 2/1989 | Funaki | 52/520 |
| 4,856,251 | A | * | 8/1989 | Buck | 52/553 |
| 4,982,541 | A | | 1/1991 | Winter, IV | |
| 5,388,381 | A | * | 2/1995 | Bilinski | 52/519 |
| 5,540,029 | A | | 7/1996 | Elias | |
| 5,577,361 | A | * | 11/1996 | Grabek, Jr. | 52/243 |
| 5,623,802 | A | * | 4/1997 | Boushek | 52/543 |
| 5,671,577 | A | | 9/1997 | Todd | |
| 5,766,678 | A | | 6/1998 | Belt | |
| 6,014,847 | A | | 1/2000 | Phillips | |

* cited by examiner

*Primary Examiner*—Carl D. Friedman
*Assistant Examiner*—Jennifer I. Thissell
(74) *Attorney, Agent, or Firm*—James J. Dottavio; Inger H. Eckert

(57) ABSTRACT

Self-aligning shingle members and self-aligning laminated shingle members. The shingle members have at least an alignment strip on the bottom surfaces which mates and nests with the top edge or corresponding alignment strip on the underlying course of shingles. In one embodiment, each of the shingle members has an alignment strip on the bottom surface which nests with the top edge of the underlying course, creating a self-aligning roofing shingle system which is easier to align and install. In another embodiment, alignment strips are provided on both the top and bottom surfaces of the shingle member and the alignment strip on the bottom surface is adopted to mate and nest with the alignment strip on the top surface of shingle members in the underlying course of shingles. This provides a self-aligning shingle system with the appearance of a three-layer laminated shingle structure. The courses of shingle members can also be interlocked together with appropriately shaped interlocking alignment strips.

19 Claims, 3 Drawing Sheets

SELF-ALIGNING SHINGLES

TECHNICAL FIELD AND INDUSTRIAL APPLICABILITY OF THE INVENTION

The present invention relates to roofing shingles and more particularly to self-aligning and laminated shingles.

BACKGROUND OF THE INVENTION

The application of roofing shingles is a labor intensive process. Each shingle has to be placed into position individually, aligned above the underlying course, and then fastened to the roof deck. Constant inspection and possible realigning is necessary in order to make sure that the shingles are situated and aligned properly. Also, laminated shingles, that is shingles having two or three layers laminated together are popular today. The aesthetics of having a thicker roofing material has resulted in a significant demand for this type of roofing system. However, laminated shingles are expensive and thus out of reach for a significant number of consumers. Thus, there is a need for roofing shingles which can be placed in position and aligned more easily and more quickly. There also is a need for a roofing system that has a laminated "look" to it without the additional cost of an actual fully laminated or thicker roofing material.

SUMMARY OF THE INVENTION

The present invention provides self-aligning shingles which are easier and faster to install and result in automatically straight rows. The shingles have an alignment strip on the bottom surface that is situated to nest against the top edge of the course immediately below. With the self-aligning shingles, each shingle is slid down over the course below until it comes to a stop when the alignment strip engages the shingle below. This results in a roof installed with the correct exposure dimensions and straight, even courses. The invention also eliminates the need for the installer to slide the shingles up and down in order to achieve a visual alignment. Once the shingles are in place, the alignment strip holds the shingles in the correct position until they are fastened. This is especially helpful on steeper slopes.

Another embodiment of the invention utilizes two alignment strips, one on the bottom surface and one on the top surface. During installation, the bottom strips of the overlying shingles in an upper course nest against the top strips on the shingles in the course below. When the alignment strips engage during installation, the bottom edge of each course reveals an extra layer of increased thickness. The resulting roof thus has a tri-laminate look with deep natural shadow lines. It has the appearance of being thicker and more massive than a roof with standard shingles. In addition, the roof automatically has appropriate exposure dimensions and straight and even courses.

It is an object of the present invention to provide shingles which are easier to align and install than present shingles. It is another object of the present invention to provide self-aligning shingles.

It is a further object of the present invention to provide a shingle system which gives the appearance of a tri-laminate shingle system. It is a still further object of the present invention to provide a shingle system which gives the appearance of a tri-laminate shingle system and also has self-aligning shingles which are easier to install and align.

These and other objects, purposes, and advantages of the present invention will become apparent from the following description of the invention when taken in view of the attached drawings and appended claims.

DETAILED DESCRIPTION AND PREFERRED EMBODIMENTS OF THE INVENTION

Figure 1:
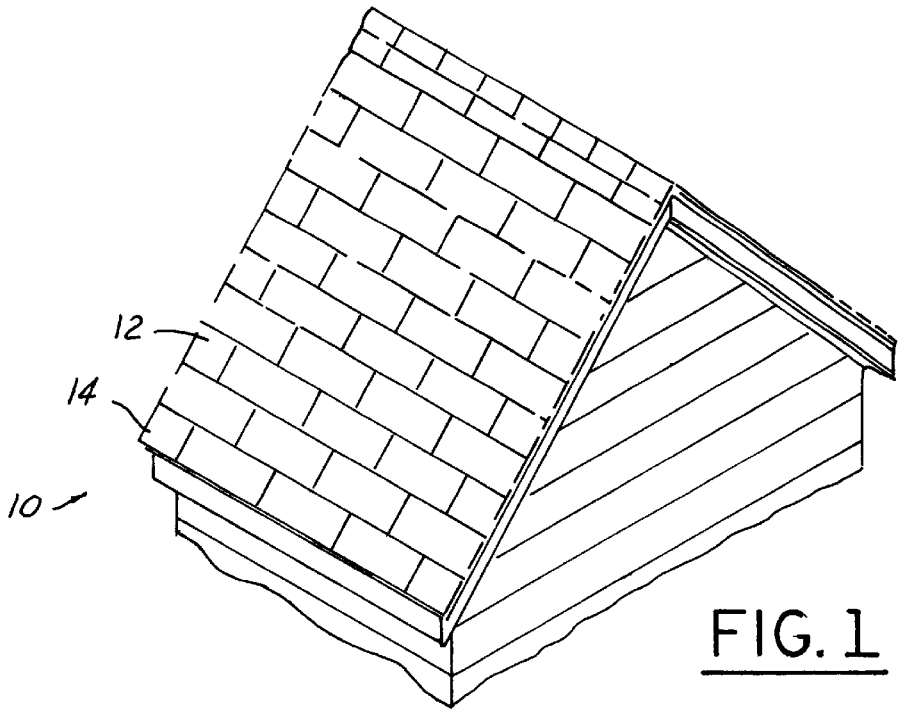
FIG. 1 schematically depicts a roof structure for use with the present invention.

The present invention relates to roof shingle members and roofing systems, particularly for use with residential houses and related structures. A representative structure is shown in FIG. 1 and referred to by the reference numeral 10. The structure 10 has a roof 12 on it which is covered by a plurality of roofing shingles 14.

The description and drawings disclose roofing shingles generally comprised of a base material and composite materials. It is to be understood that the base material can be any suitable support material. Common base materials include organic felt and fiberglass mat. It is also to be understood that the composite materials may be any suitable combination of materials. The composite materials are preferably low in cost, have a long service life, and are fire-resistant. Common composite materials include asphalt coating and mineral granules.

Figure 2:
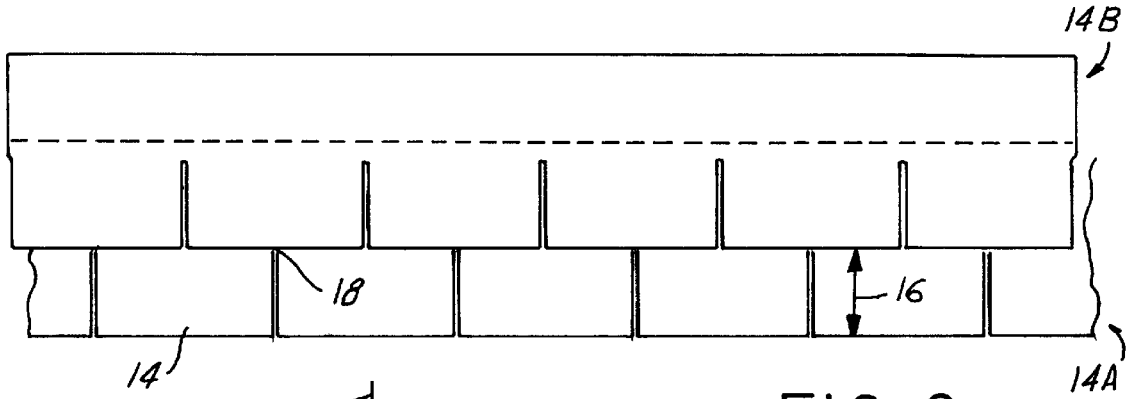
FIG. 2 is an elevational view illustrating roofing shingles positioned on a roof in accordance with the present invention.

As shown in FIG. 2, the roofing shingles 14 are installed on the roof deck in an overlying and aligned manner. The first layer or course of roofing shingles 14A is installed on the roofing deck and then a second layer 14B is installed partially over the first course leaving a certain distance 16 of the first layer 14A exposed.

Currently, when roofing shingle members such as 14 are installed on a roof deck, the individual shingle members are slid and positioned in place by the installer. Once the first row 14A is installed, aligned, and fastened in place, a second set of shingle members 14B are slid partially over the first layer and individually aligned visually by the operator leaving the appropriate exposed area 16. Also, as indicated in FIG. 2, the individual shingle members are also overlapped in a horizontal direction. In this manner, the seams or joints 18 between individual shingle members in one row are covered by a solid shingle member in the next row.

Figure 3:
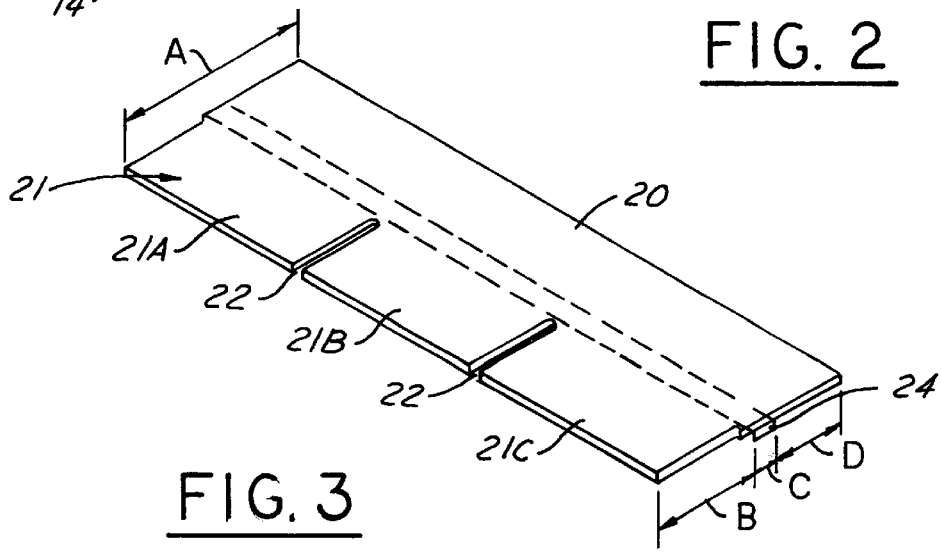
FIG. 3 is a perspective view illustrating an embodiment of a roofing shingle member in accordance with the present invention.

An individual roofing shingle member in accordance with the present invention is shown in FIG. 3 and referred to generally by the reference numeral 20. This shingle member 20 is preferably an asphalt shingle member of standard size and dimensions. In this regard, the shingle members typically have a height or width dimension "A" of 12 inches and a length of approximately 36 inches. In addition, the exposed portion 21 of the shingle member 20 is typically formed into three tab members 21A, 21B and 21C. For this purpose, a pair of slots 22 are cut or formed in the shingle member 20.

The shingle member 20 has an alignment strip member 24 attached on the bottom or rear surface. The alignment strip member can be another piece of an asphalt shingle or the like and secured to the shingle member 20 mechanically or adhesively, such as by a hot melt adhesive or the like. The strip member 24 could be cut from the web during manufacture of the shingles and laminated to the back of the shingle. The strip can be attached either granule side up or granule side down. The strip is applied under a headlap portion of each of the shingle members. The alignment strip members 24 are located on the bottom surface of the shingle members at a position equal to the exposure E (FIG. 4) plus two inches. Thus, distance B in FIG. 3 is E plus two inches. The exposure E is also referenced by the numeral 16 in FIG. 2.

Figure 5A:
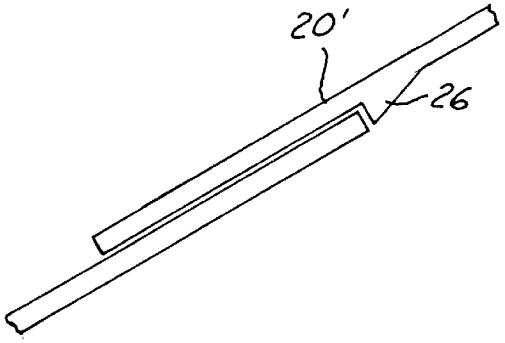
FIGS. 5A and 5B illustrate two additional embodiments of self-aligning mechanisms in accordance with the present invention.
Figure 5B:
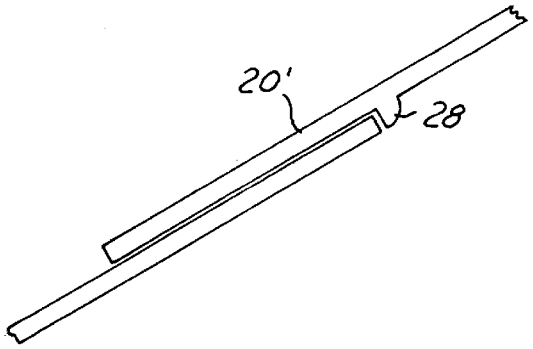

The alignment strips 24 can be made of any flexible material with approximately the same thickness of the body of the shingle in order to create a raised edge. It also could be made of a plastic material or any other flexible material with a variety of profiles. In this regard, two additional profiles are shown in FIGS. 5A and 5B. In FIG. 5A, the alignment strip 26 has a wedge shape, while in FIG. 5B the alignment strip 28 has a quarter-round shape. By these examples, it is understood that the alignment strip can have any appropriate cross-sectional shape so long as it provides the necessary functions as described herein.

The alignment strips preferably comprise a single continuous piece of material extending the full distance across the shingle member, although they could also be comprised of a series of short sections, particularly where shingles with tabs are utilized and a continuous alignment would be visible through the cutouts between the tabs.

The alignment strips 24 could also have an adhesive backing and be applied to the individual shingle members 20 or strips thereof from a roll or coil similar to the manner in which release tape is currently being applied to asphalt shingle members.

Figure 4:
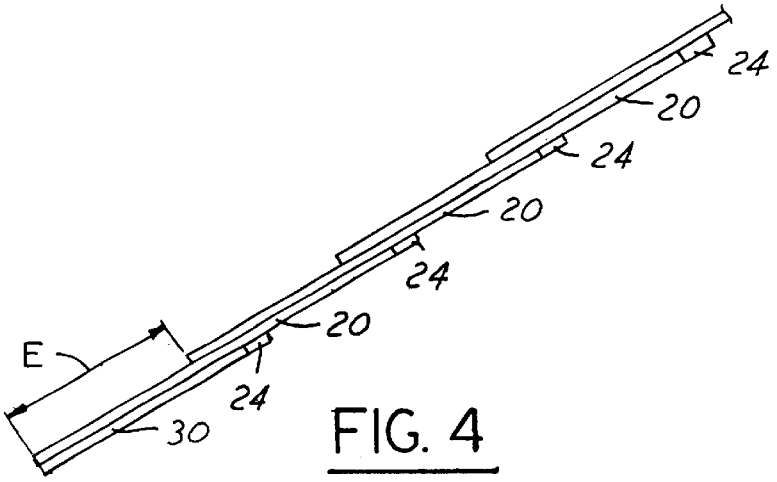
FIG. 4 illustrates the installation of a plurality of shingle members in accordance with a first embodiment of the present invention.

In use, the shingle members 20 are positioned on a roof deck or the like in the manner set forth in FIG. 4. A starter strip 30, which typically is a shortened shingle member, is first placed on the roof deck. Thereafter, a first layer or course of shingle members 20 are installed on the roof, followed by a second layer immediately above. This process continues until the entire roof deck is covered.

When the shingle members 20 are installed, the alignment strip 24 nests against the top edge of the course below. With the self-aligning shingle member, the installer slides the shingle 20 down over the course below until it comes to a stop as the alignment strip 24 engages the top edge of the shingle below. The result is a roof installed with correct exposure dimensions and straight and even courses. This eliminates the need for the installer to slide the shingle up and down trying to get a visual alignment, or rely upon eyesight for correct positioning.

For one layer (strip) shingles, the shingles can be tabbed shingles or solid rectangles without cutouts or tabs. Also, it is to be understood that the particular alignment system utilized is not limited to any particular shingle construction.

Once the shingle is in place, the alignment strip holds the shingle in its correct position until it is fastened. This is especially helpful on steeper slopes. The self-aligning shingles provide faster and easier installation and a more aesthetic looking roof with automatically straight rows.

In a preferred embodiment, the alignment strip is provided directly at the nailing strip location for the shingle. The installer will therefore secure the shingle to the deck by nailing through the front alignment strip member 56 and through the main layer 52, of the shingle, and into the roof deck. Accordingly, the roofing nails will bear against two layers in each shingle and therefore offer more resistance to pull-through. In addition, the strip 56 may be made of a plastic material or such that provides additional resistance to pull-through.

The present invention also addresses one of the key drawbacks of shingles with uneven tab lengths. These shingles are popular for their random look, but are difficult to install correctly since the tabs cannot be aligned with the cutouts of the shingle in the course below. Typically, a premium is charged by installers in order to install shingle members with uneven tabs. With the present invention, however, the alignment strip automatically insures straight installation regardless of the shape of the lower edge.

On a standard 12-inch by 36-inch strip shingle member, the lower edge of the alignment strip 24 is applied on the bottom surface of the shingle seven inches from the bottom edge. This is dimension "B" in FIG. 3. The width of the alignment strip itself can vary, but should be approximately one inch in width. This is dimension "C" in FIG. 3. If the attachment strip 24 is one inch in width, then dimension "D" will be four inches. Finally, when the shingle members 20 are installed on a roof, the exposure of subsequent rows is typically five inches. This is dimension "E" in FIG. 4.

Figure 6:
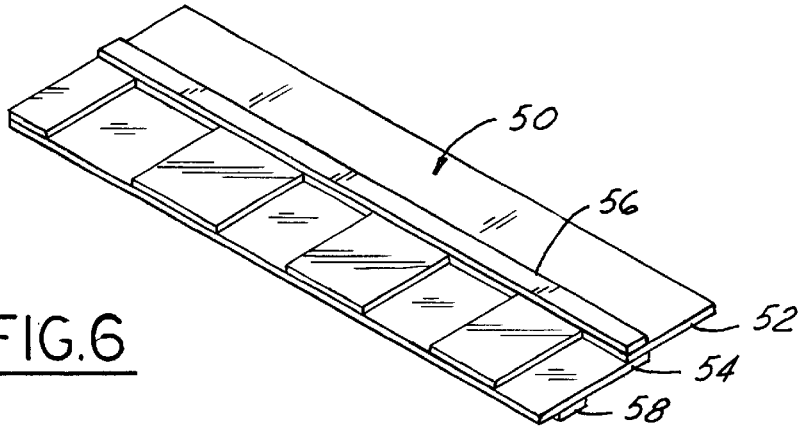
FIG. 6 is a perspective view illustrating a second embodiment of the present invention.
Figure 7:
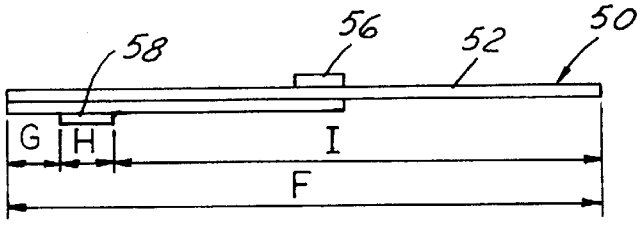
FIG. 7 is an end view of the embodiment of the invention shown in FIG. 6.
Figure 8:
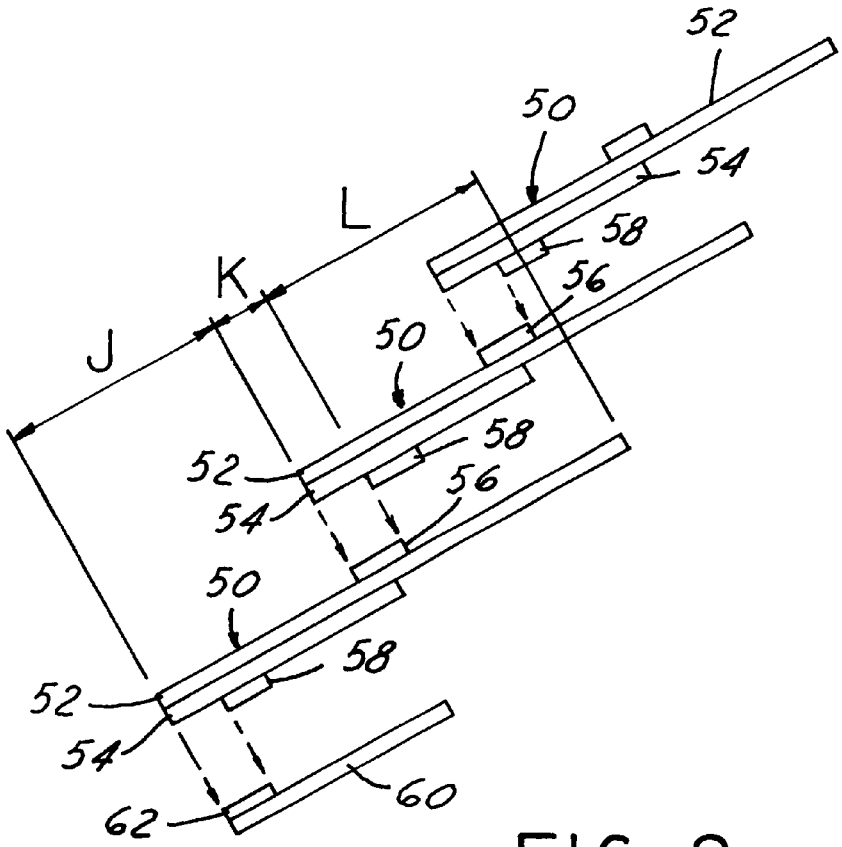
FIG. 8 illustrates the installation of roofing shingle members in accordance with the second embodiment of the present invention.

A second embodiment of the present invention is shown in FIGS. 6–8 and referred to generally by the reference numeral 50. This embodiment of the present invention provides not only a self-aligning shingle member, but a shingle member that creates the look of a laminated shingle, such as a three-layer laminate (tri-laminate) shingle. As shown in FIGS. 6 and 7, the shingle member 50 includes a main layer 52, an underlay member 54 positioned on the bottom surface of the main layer, and a pair of alignment strips 56 and 58. The alignment strips 56 and 58 are positioned on opposite sides of the shingle member 50.

Similar to the embodiment discussed above with reference to FIGS. 3–4, the shingle member 50 is preferably comprised of portions of asphalt shingle members which are secured together, such as by hot melted adhesive, self-adhesive strips, or the like. Preferably, the layers are pressed and laminated together in order to insure that they are secured permanently together. Also, the alignment strip members 56 and 58 could be provided from a plastic material or another conventional material having the requisite durability and flexibility to perform the desired functions.

For one layer (strip) shingles, the shingles can be tabbed shingles or solid rectangles without cut-outs or tabs. If tabbed shingles are utilized, the alignment strips can be non-continuous strip sections, as indicated above. For example, a three-tab shingle could have two sections of alignment strips centered over the two cut-out slots. Also, it is to be understood that the particular alignment system utilized is not limited to any particular shingle construction.

The alignment strip members 56 are located at a distance J from the front edge of the shingle members. The distance J is equal to the exposure of the shingle member. The distance from the lower edge of the shingle member 52 to the lower edge of the bottom alignment strip 58 (distance G in FIG. 7) equals the width of the top alignment strip (distance K in FIG. 8). These dimensions apply to any size shingle where the bottom edge is essentially straight, as shown in FIG. 6.

When the self-aligning laminated shingles are installed on a roof deck, preferably a course of starter strips, such as shingle members 60 (FIG. 8) are utilized. The starter shingle members 60 each include an alignment strip 62 on the top surface to nest with the bottom alignment strip 58 on the immediate overlying course of shingle members 50. In this regard, the alignment strip 62 is preferably provided of the same material as the shingle members 50 and can be secured to the starter shingle member 60 in any conventional manner, as discussed above. The alignment strip is also provided preferably at the nailing strip location for the shingle.

Once the starter shingle member 60 is installed and fastened in position, a first layer of shingle members 50 are installed in place. During installation, the bottom strip 58 of the overlying shingle member 50 mates and nests against the top alignment strip 56 on the course below. (In the initial course, the bottom strip nests with the alignment strip 62 on the starter shingle member 60.)

With the self-aligning shingle member, the installer slides the shingle down over the course below until it comes to a stop as the alignment strips engage with one another. This eliminates the need for the installer to slide the shingle up and down trying to get a visual alignment. Once the shingle is in place, the nested alignment strips hold the shingles in the correct position until they are fastened. This is especially helpful on steeper slopes.

In the same manner as discussed above, the second embodiment of the invention also automatically insures straight installation of shingle members with uneven tabs thereon.

When the alignment strips are engaged during installation, the bottom edge of each course reveals an extra layer of increased thickness. The resulting roof has a tri-laminate look with deep natural shadow lines. It has the appearance of being thicker and more massive than a roof with standard laminated shingles. In addition, the roof has correct exposure dimensions and straight and even courses.

Figure 9A:
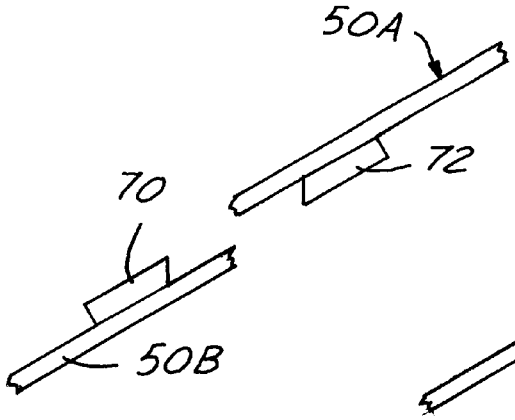
FIGS. 9A and 9B illustrate additional interlocking mechanisms for use with the present invention.
Figure 9B:
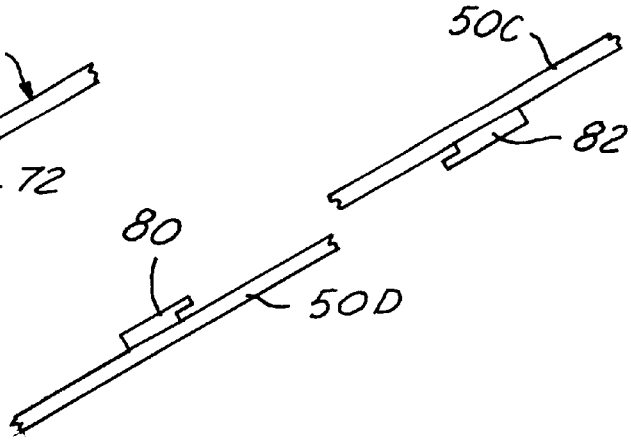

FIGS. 9A and 9B illustrate two additional embodiments of alignment strips which can be utilized with the present invention. As shown in FIG. 9A, the alignment strips 70 and 72 have interlocking angled surfaces which nest tightly together when the shingle members 50A and 50B are placed one on top of the other.

In FIG. 9B, the alignment strips 80 and 82 are formed with mating tongue-and-groove configurations which also allow the shingle members 50C and 50D to be tightly interlocked together during installation.

The present invention can be utilized with shingles of virtually any size, including conventional 12-inch by 36-inch shingles, or metric size shingles (typically 13¼"× 39").

In the embodiments shown in FIGS. 6–8, the alignment strips can be cut from the web during manufacture and laminated to the front and back surfaces of the shingle member 50. The strips can be attached either granule side up or granule side down. The strips can also be made of any flexible material of approximately the same thickness as the body of the shingle to create a raised edge. They could also be made of plastic or any flexible material with a variety of profiles, as discussed above with reference to FIGS. 9A and 9B. In addition, the strips can have an adhesive backing and be applied to the shingles from a roll or coil similar to the manner in which release tape is currently applied to asphalt shingle members.

The edges of the alignment strips could be made merely to contact each other, as shown in FIG. 8, or also could be provided to mate together (or "lock" the shingle courses together) and improve wind performance, as shown, in FIGS. 9A and 9B. The location of the shingle sealant could be placed adjacent to the alignment strips to form a strong seal.

With the embodiment of shingle members shown in FIGS. 6–8, the dimensions are as follows: F=13.25 inches; G=1 inch; H=1 inch; I=11.25 inches; J=5.625 inches; K=1 inch; and L=6.625 inches. In this regard, G should be the same as K.

With the tri-laminated embodiment of the present invention, a tri-laminated structure is provided without the cost of conventional tri-laminated shingle members. One skilled in the art may also apply the teachings of this embodiment to a strip shingle, and thereby achieve a two-layer laminate shingle appearance at the bottom edge at minimal cost with the alignment features provided herein. Also, with the pairs of alignment strips 56 and 58 on opposite sides of the main layer 50, stacks of the shingle members are more uniform for packaging.

While the invention has been described in connection with one or more embodiments, it is to be understood that the specific mechanisms and techniques which have been described are merely illustrative of the principles of the invention. Numerous modifications may be made to the methods and apparatus described without departing from the spirit and scope of the invention as defined by the appended claims.

What is claimed is:

1. A roofing shingle comprising a rectangular shingle member having a top surface and a bottom surface, a first alignment strip member positioned on said top surface of said shingle member, an underlay shingle member secured to said bottom surface of said shingle member and having a bottom surface, and a second alignment strip member positioned on said bottom surface of said underlay shingle member wherein when said roofing shingle is installed on a surface overlying a previously installed shingle member of the same configuration, the second alignment strip mates and nests with the first alignment strip of the course below.

2. The roofing shingle as set forth in claim 1 wherein said first and second alignment strip members extend the full width of the rectangular shingle member.

3. The roofing shingle as set forth in claim 1 wherein said shingle member and said first and second alignment strip members are made from an asphalt shingle material.

4. The roofing shingle as set forth in claim 1 wherein said first and second alignment strip members are made from a plastic material.

5. The roofing shingle as set forth in claim 1 wherein said first and second alignment strip members have mating interengaging structures, such that when a second course of shingle members is positioned on a first course of shingle members, the alignment strips mate and interlock together.

6. The roofing shingle as set forth in claim 1 wherein said rectangular shingle member has a plurality of alternating cutouts and tabs along one edge thereof.

7. A roofing system comprising a first course of shingle members and at least a second course of shingle members overlying at least a portion of said first course of shingle members, said first course of shingle members comprising a rectangular shingle member having a top surface and a bottom surface, a first alignment strip member positioned on the top surface of said shingle member and a second alignment strip member positioned on the bottom surface of said shingle member, wherein when said roofing shingle is installed on a surface overlying a previously installed shingle member, the first and second alignment strips mate and nest together, and said second course of shingle members comprising a rectangular shingle member having a top surface and a bottom surface, a first alignment strip member positioned on the top surface of said shingle member and a second alignment strip member positioned on the bottom surface of said shingle member further comprising a second underlay shingle member secured to the bottom surface of said shingle members in each of said first and second courses of shingle members and positioned between said shingle member and said corresponding second alignment member wherein when said roofing shingle is installed on a surface overlying a previously installed shingle member, the second alignment strip of said shingle members in said second course of single members meet and nest together with the first alignment strip of said second shingle member in said first course of shingle members.

8. The roofing system as set forth in claim 7 wherein said first and second alignment strip members have mating interengaging structures, such that when a second course of shingle members is positioned on a first course of shingle members, the alignment strips mate and interlock together.

9. The roofing system as set forth in claim 7 further comprising a course of starter shingle members, wherein said starter shingle members are installed on a surface under said first course of shingle members.

10. The roofing system as set forth in claim 7 wherein said first and second alignment strips of each of said course of shingle members extend the full width of the shingle members.

11. The roofing system as set forth in claim 7 wherein each of said shingle members and first and second alignment strip members are made from an asphalt shingle member.

12. The roofing system as set forth in claim 7 wherein said first and second alignment strip members are made from a plastic material.

13. The roofing system as set forth in claim 7 wherein each of said shingle members has a plurality of alternating cutouts and tabs along one edge thereof.

14. A method of installing a plurality of roofing shingles to a roof deck, said roofing shingles each comprising a rectangular shingle member having a top surface and a bottom surface, an underlay shingle member secured to said bottom surface of said rectangular shingle member and having a bottom surface, a first alignment strip member positioned on said top surface of said rectangular shingle member and a second alignment strip member positioned on said bottom surface of said underlay shingle member, said method comprising the steps of:

nesting said second alignment strip member of each of said roofing shingles with one of a previously installed shingle or starter strip; and securing said plurality of shingles to said roof deck.

15. The method as set forth in claim 14 wherein said step of nesting comprises abutting said alignment strip to an upper edge provided on one of a previously installed shingle or starter course.

16. The method as set forth in claim 14 wherein said step of nesting comprises abutting said second alignment strip to a first alignment strip on one of a previously installed shingle or starter course.

17. The method as set forth in claim 16 wherein said step of nesting further comprises interlocking said second alignment strip with said first alignment strip.

18. The method as set forth in claim 16 wherein said second alignment strip is provided under a headlap portion of each of the plurality of shingles.

19. The method as set forth in claim 16 wherein said plurality of shingles are secured to said deck through said first alignment strip.

* * * * *